US006115987A

United States Patent [19]

Tatum

[11] Patent Number: 6,115,987

[45] Date of Patent: Sep. 12, 2000

[54] VERTICAL REBAR SUPPORT SYSTEM AND METHOD

[76] Inventor: Charles R. Tatum, 120 East Ave., Naples, Fla. 34108

[21] Appl. No.: 09/206,718

[22] Filed: Dec. 7, 1998

[51] Int. Cl.[7] ..... E04B 1/14

[52] U.S. Cl. ..... 52/741.1; 52/684; 52/685; 52/689

[58] Field of Search ..... 52/294, 295, 677, 52/678, 679, 681, 682, 683, 684, 685, 686, 687, 688, 689, 741; 249/207, 210

[56] References Cited

U.S. PATENT DOCUMENTS

| | | | |
|---|---|---|---|
| 4,190,999 | 3/1980 | Hampton . | |
| 4,575,985 | 3/1986 | Eckenrodt | 52/677 |
| 4,640,063 | 2/1987 | Ayala . | |
| 5,216,866 | 6/1993 | Ekedal | 52/677 |
| 5,400,562 | 3/1995 | Bahr | 52/677 |
| 5,595,039 | 1/1997 | Lowery . | |
| 5,616,272 | 4/1997 | McCrystal . | |
| 5,688,428 | 11/1997 | Maguire . | |

*Primary Examiner*—Carl D. Friedman
*Assistant Examiner*—Kevin McDermott
*Attorney, Agent, or Firm*—Merrill N. Johnson

[57] ABSTRACT

A vertical-rebar-support system has a ring base (1) oriented horizontally intermediate side walls (2) of a concrete-foundational excavation (3). A vertical-rebar receptacle (4, 9, 10, 18) is off-centered on the ring base and a rebar-L-base receptacle (7, 8) for an L-bent rebar (5) is disposed oppositely on the ring base to retain a vertical rebar rigidly upright. Optionally, a vertical rebar (17) without an L-bend can be used for some construction and in non-hurricane areas. The ring base and vertical rebar can be positioned above or below horizontal rebar (13) proximate a bottom (15) of the concrete-foundational excavation. A use method is rotating the ring base with the vertical rebar attached to position the vertical rebar laterally between the side walls of the concrete-foundational excavation while moving the ring base intermediate terminal ends (19) of the concrete-foundational excavation in accordance with a guide line (20) and desired measurements.

5 Claims, 4 Drawing Sheets

1
2
3
5
6
7
9
11
13
14
15
16
17
18
19
20

VERTICAL REBAR SUPPORT SYSTEM AND METHOD

BACKGROUND OF THE INVENTION

1. Field of the Invention

This invention relates to positioning reinforcement bars (rebars) vertically in concrete footings and foundations of buildings and other structures while the concrete is being poured and set preparatory to constructing building walls and other forms on the footings and foundations.

2. Relation to Prior Art

Within the last decade, hurricane and tornado damage to buildings not anchored adequately to sufficient footing and foundation structure has prompted new laws with rules and regulations that set standards for concrete foundation structure and anchorage of walls and roofs with reinforcement bars (rebars) for most types of buildings. Vertical rebar of an appropriate size and strength is required to be anchored to horizontal rebar that is embedded in concrete footing. For most building requirements, the vertical rebar is extended vertically from an appropriate embedment in the concrete footing for attachment to roofing every four feet of outside wall distance. A continuity of rebar strength between the concrete footing and the roof must be sufficient to anchor structural sizes, shapes and types of buildings against vertical lift and horizontal side pressure of specified wind velocities.

Individuals, firms and organizations interested in construction, architecture and societal welfare have responded with a variety of known means and methods for meeting the needs and intent of these new rules, regulations and standards. None, however, are known to provide the level of structural integrity with the convenience, economy and reliability of the vertical rebar support system taught by this invention.

Examples of different but related rebar means are described in the following patent documents. U.S. Pat. No. 5,616,272, issued to McCrystal, described a spring-frame clip with excess and redundant spring rod sections for aligning and supporting rebar. U.S. Pat. No. 5,595,039, issued to Lowery, described a rebar chair having a base with a central opening that received a stem to be cut to a desired length and provided with a concave top to support a length of rebar to be embedded in concrete.

SUMMARY OF THE INVENTION

Problems with supporting vertical rebar for concreting footings and foundations continue to exist. Objects of patentable novelty and utility taught by this invention are to provide a vertical-rebar-support system which:

Provides ease and convenience of positioning vertical rebars in line and evenly spaced at appropriate intervals;

Holds rebar in place vertically while horizontal footings, foundations and vertical columns of concrete are being poured about it;

Concrete-locks the vertical rebar to one or a plurality of desired horizontal rebars with full tensile strength of the vertical rebar, with high structural integrity and with unyielding high reliability;

Provides a rebar base independently of or in combination with horizontal rebars in foundational excavations;

Is convenient and easy to position the vertical rebar and the horizontal rebar in concrete-locking assembly;

Can be adjusted quickly and easily to desired heights and positions of horizontal rebar;

Is easily adaptable to foreseeable rebar structure;

Is inexpensive to manufacture; and,

Is convenient to store, to transport and to handle.

This invention accomplishes these and other objectives with a vertical-rebar-support system having a ring base oriented horizontally intermediate side walls of a concrete-foundational excavation. A vertical-rebar receptacle is off-centered on the ring base and a rebar-L-base receptacle for an L-bent rebar is disposed oppositely on the ring base to retain a vertical rebar rigidly upright. Optionally, a vertical rebar without an L-bend can be used for some construction and in non-hurricane areas. The ring base and vertical rebar can be positioned above or below foundational rebar proximate a bottom of the concrete-foundational excavation. A use method is rotating the ring base with the vertical rebar attached to position the vertical rebar laterally between the side walls of the concrete-foundational excavation while moving the ring base intermediate terminals of the concrete-foundational excavation in accordance with a guide line and desired measurements.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
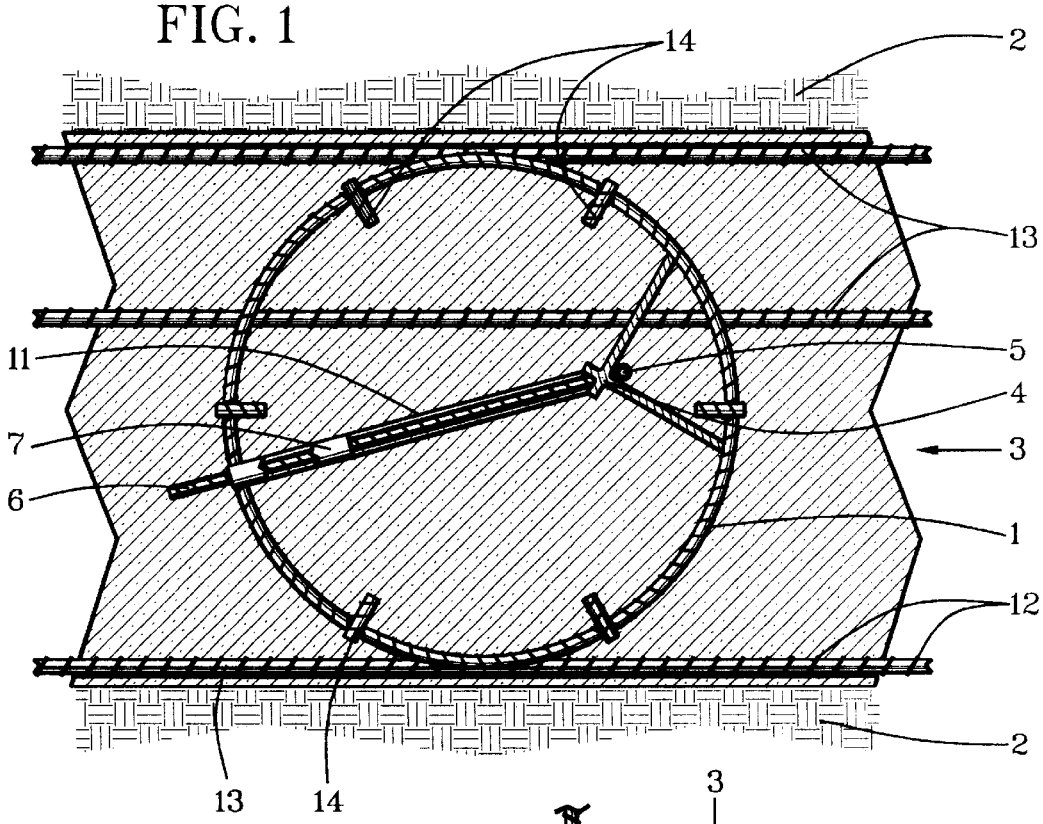
FIG. 1 is a partially cutaway top view of a ring base having a vertical section of an L-bent vertical rebar positioned in an outwardly-facing channel of a multiple-channeled vertical-rebar receptacle and having a rebar-L-base in a tubular rebar-L-base receptacle with the ring base resting on a plurality of horizontal rebars in a portion of a concrete-foundational excavation.

Terms used to describe features of this invention are listed below with numbering in the order of their initial use with reference to the drawings. These terms and numbers assigned to them designate the same features wherever used throughout this description.

| | |
|---|---|
| 1. Ring base | 11. Receptacle base |
| 2. Side walls | 12. Rebar brads |
| 3. Concrete-foundational excavation | 13. Horizontal rebars |
| 4. Multi-channeled receptacle | 14. Base bars |
| 5. L-bent rebar | 15. Foundational bottom |
| 6. Rebar-L-base | 16. Riser blocks |
| 7. Tubular rebar-L-base receptacle | 17. Non-bent vertical rebar |
| 8. Channeled rebar-L-base receptacle | 18. Tubular rebar receptacles |
| 9. Ring-facing vertical channel | 19. Terminal ends |
| 10. Center-facing vertical channel | 20. Guide line |

Referring first to FIGS. 1–6, a vertical-rebar-support system has a ring base 1 with an outside periphery that fits horizontally intermediate side walls 2 of a concrete-foundational excavation 3. At least one vertical-rebar receptacle is oriented vertically and affixed to a top of the ring base 1 intermediate a center and an outside periphery of the ring base 1. As depicted in FIGS. 1–2, 4 and 7, the vertical-rebar receptacle can be a multi-channeled receptacle 4 for receiving a vertical section of an L-bent rebar 5 having a rebar-L-base 6.

For placing the vertical section of the L-bent rebar 5 in the multi-channeled receptacle 4 laterally from a ring-base side, a tubular rebar-L-base receptacle 7 is provided intermediate the center and a position on the outside periphery of the ring base 1 that is disposed oppositely from the vertical-rebar receptacle such as the multi-channeled receptacle 4.

For placing the vertical section of the L-bent rebar 5 in the multi-channeled receptacle 4 laterally from an L-base-receptacle side, a channeled rebar-L-base receptacle 8 is provided intermediate the center and a position on the outside periphery of the ring base 1 that is disposed oppositely from the vertical-rebar receptacle such as the multi-channeled receptacle 4.

Figure 6:
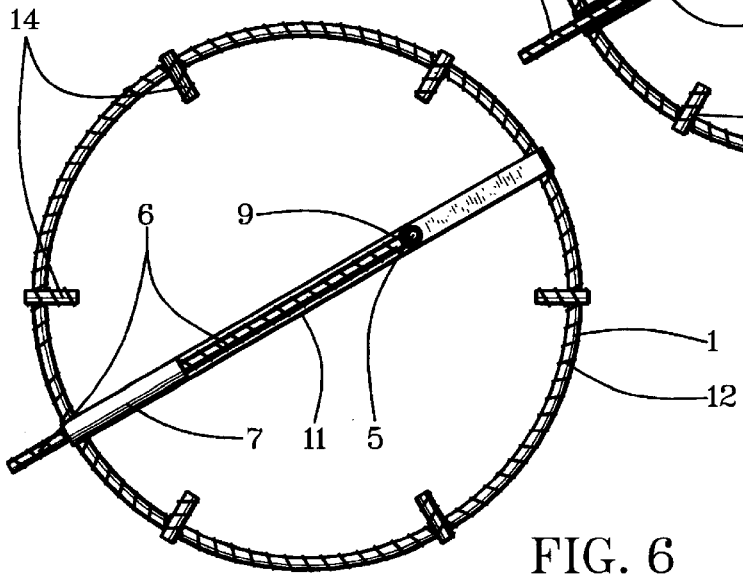
FIG. 6 is a top view of a ring base having a vertical section of an L-bent vertical rebar positioned in an outwardly-facing channel of a single-channeled vertical-rebar receptacle and having a rebar-L-base in a tubular type of rebar-L-base receptacle.
Figure 6A:
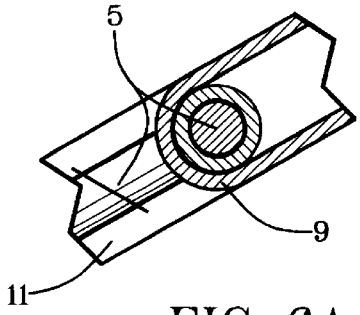
FIG. 6A is a detailed view of a portion of FIG. 6.

As shown in FIG. 6, the vertical-rebar receptacle can be a ring-facing vertical channel 9 having a rebar entry facing outwardly from the center of the ring base 1. For placing the vertical section of the L-bent rebar 5 in the ring-facing vertical channel 9 laterally from a ring-base side, the tubular rebar-L-base receptacle 7 is employed to contain the rebar-L-base 6.

Figure 5A:
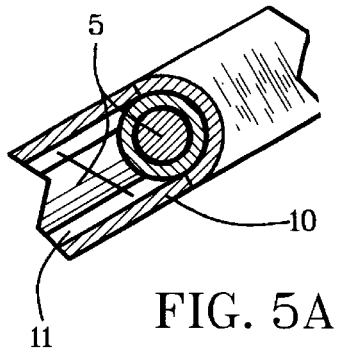
FIG. 5A is a detailed view of a portion of FIG. 5.
Figure 5:
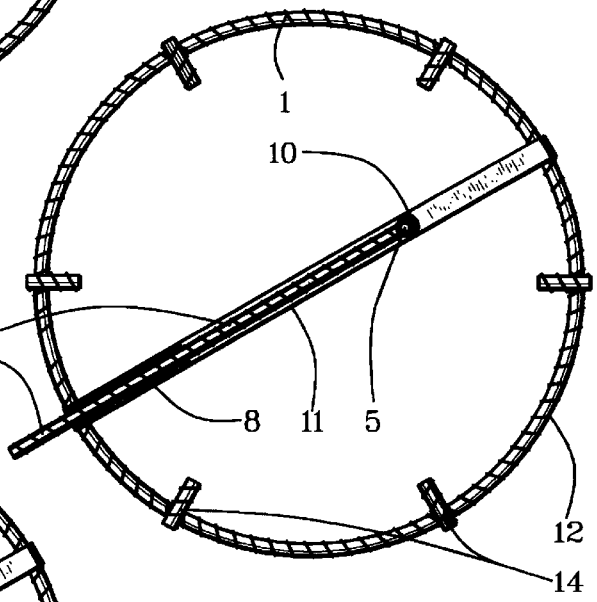
FIG. 5 is a top view of a ring base having a vertical section of an L-bent vertical rebar positioned in an inwardly-facing channel of a single-channeled vertical-rebar receptacle and having a rebar-L-base in a channel type of rebar-L-base receptacle.

As shown in FIG. 5, the vertical-rebar receptacle can be a center-facing vertical channel 10 having a rebar entry facing inwardly towards the center of the ring base 1. For placing the vertical section of the L-bent rebar 5 in the center-facing vertical channel 10 laterally from a ring-center side, the channeled rebar-L-base receptacle 8 is employed to contain the rebar-L-base 6.

Figure 2:
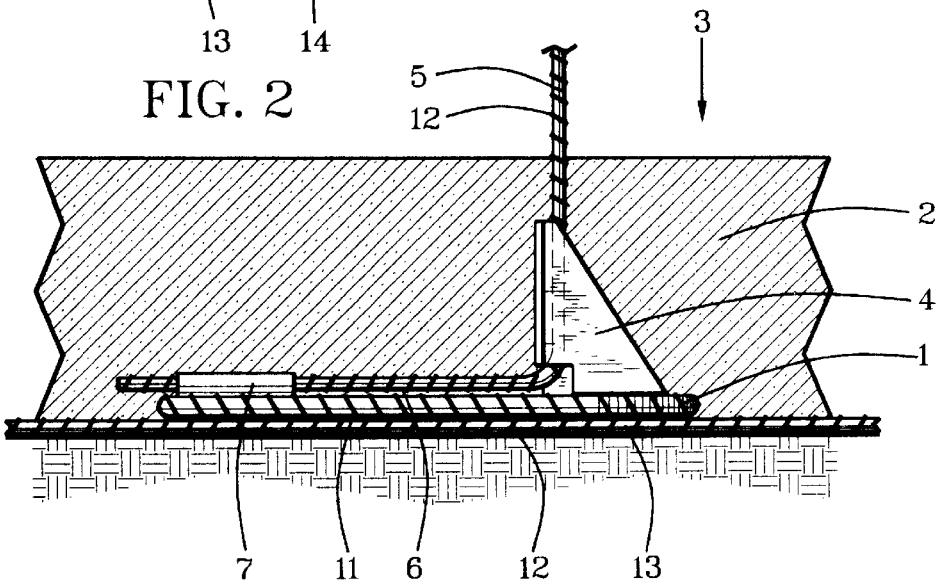
FIG. 2 is a side view of the FIG. 1 illustration.
Figure 3:
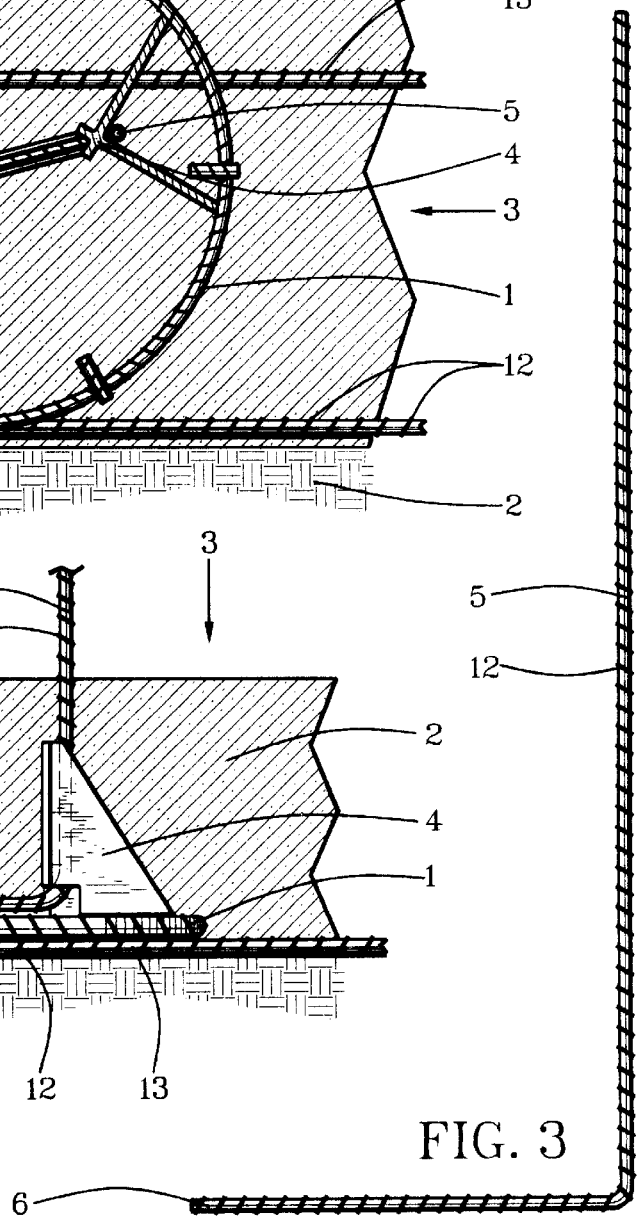
FIG. 3 is a side view of an L-bent vertical rebar.
Figure 4:
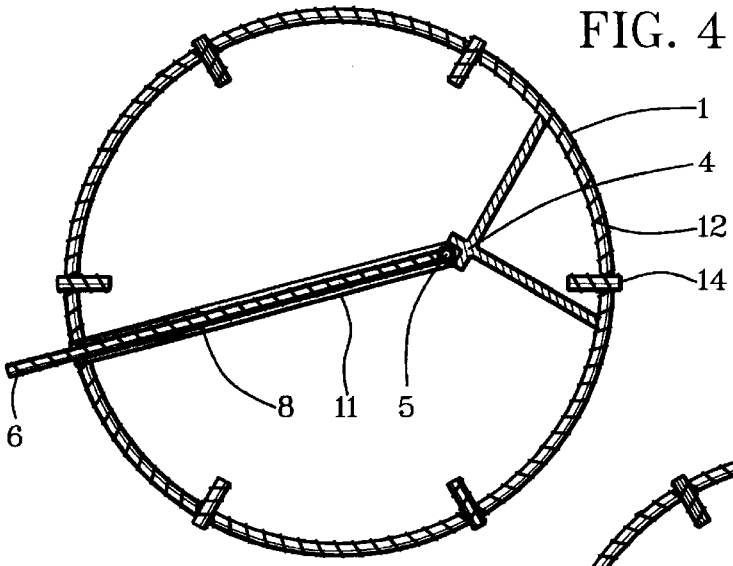
FIG. 4 is a top view of a ring base having a vertical section of an L-bent vertical rebar positioned in an inwardly-facing channel of a multiple-channeled vertical-rebar receptacle and having a rebar-L-base in a channel type of rebar-L-base receptacle.

A receptacle base 11 can be extended from side-to-side as shown in FIGS. 5–6 or from a multi-channeled receptacle 4 to an opposite side as shown in FIGS. 1–2 and 4.

In addition to rebar brads 12 and horizontal rebars 13, a plurality of base bars 14 positioned circumferentially on the ring base 1 can be employed to embed the ring base 1 firmly in concrete.

Figure 7:
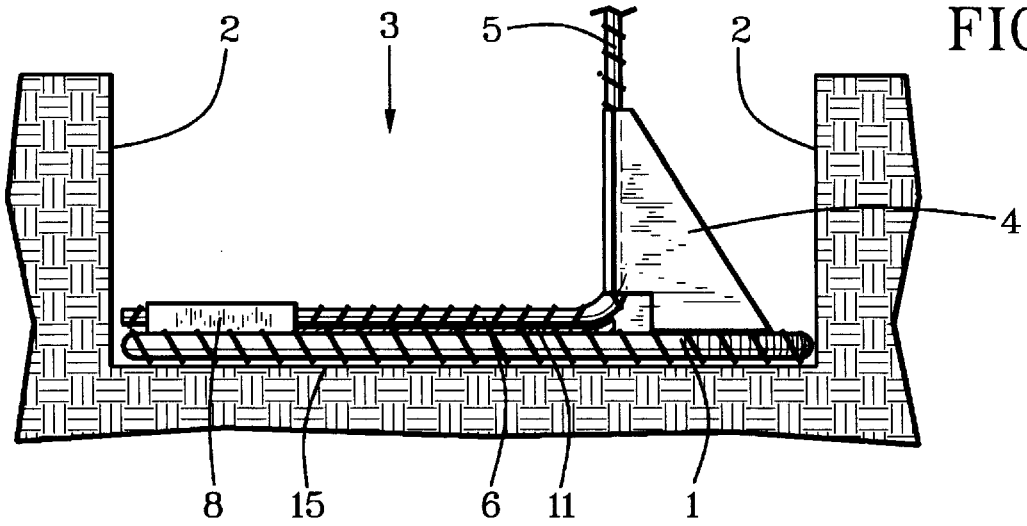
FIG. 7 is a side elevation view of the FIG. 4 ring base and L-bent vertical rebar positioned on a bottom of a concrete-foundational excavation without horizontal rebar.
Figure 8:
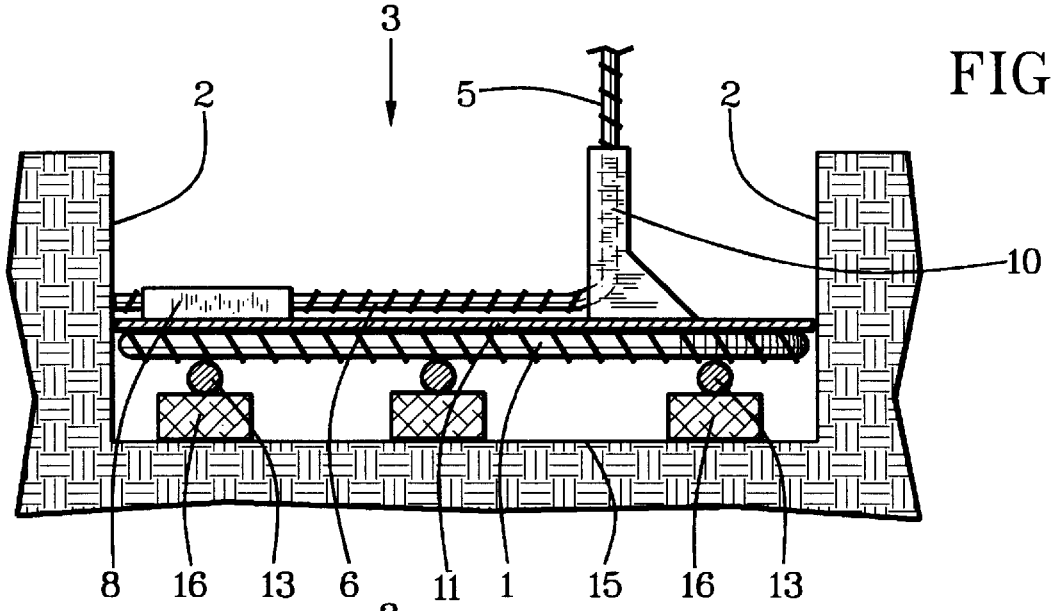
FIG. 8 is a side elevation view of the FIG. 5 ring base and L-bent vertical rebar positioned on a plurality of horizontal rebars on riser blocks on a bottom of a concrete-foundational-excavation.
Figure 9:
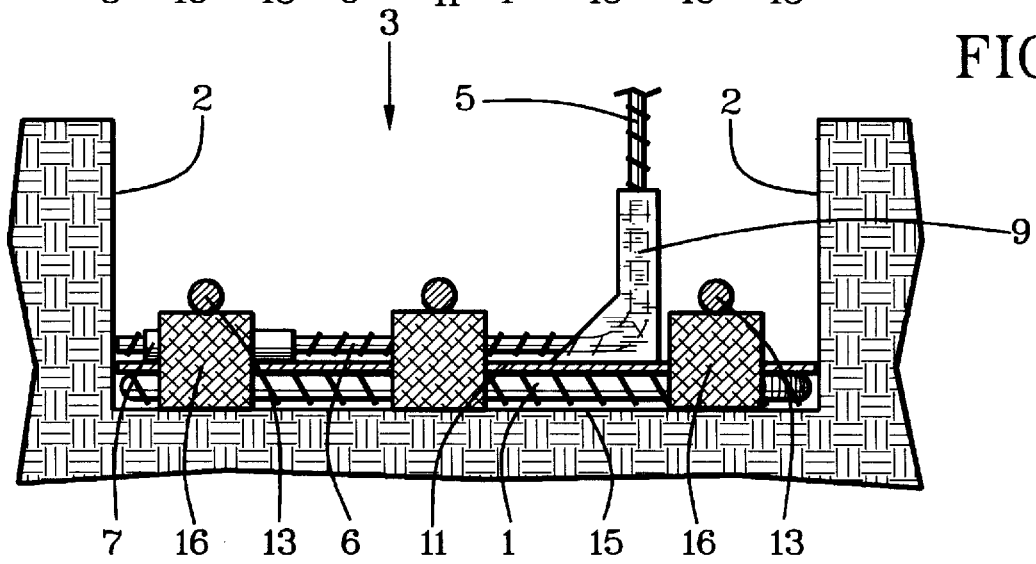
FIG. 9 is a side elevation view of the FIG. 6 ring base and L-bent vertical rebar positioned on a bottom of a concrete-foundational excavation and under a plurality of horizontal rebars on riser blocks at a side of the ring base.
Figures 10, 11, 12, 13, 14:
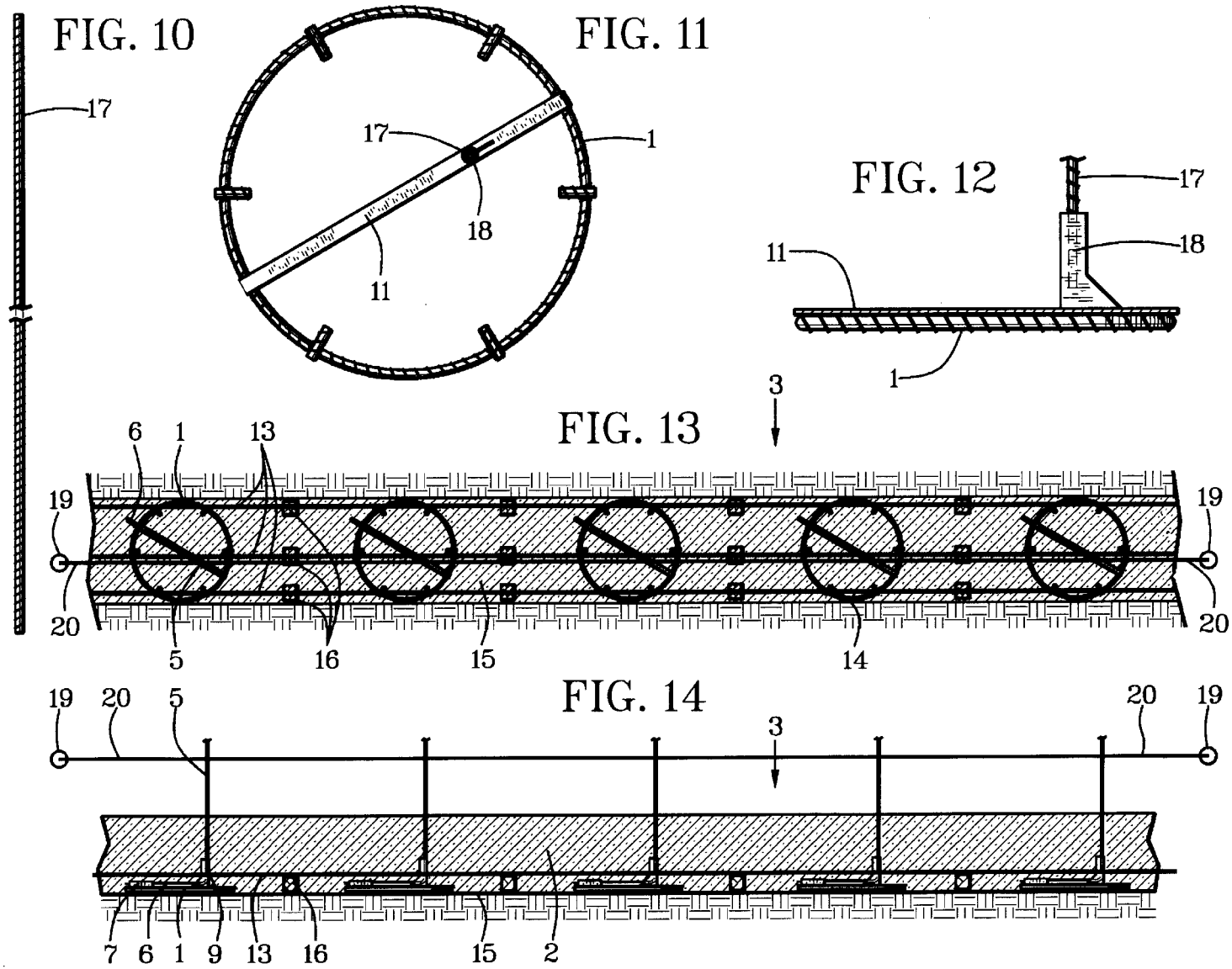
FIG. 10 is a partially cutaway side elevation view of a straight vertical rebar that is not L-bent.
FIG. 11 is a top view of a ring base having a bottom section of a non-bent vertical rebar positioned in a tubular type of a single-channeled vertical-rebar receptacle.
FIG. 12 is a side view of the FIG. 11 illustration.
FIG. 13 is a top view of a plurality of ring bases with L-bent vertical rebars positioned on a plurality of horizontal rebars for alignment with a guide line in a section of a concrete-foundational excavation.
FIG. 14 is a side view of a plurality of ring bases with L-bent vertical rebars positioned under a plurality of horizontal rebars for alignment with a guide line in a section of a concrete-foundational excavation.

Referring to FIGS. 7–9, the ring base 1 can rest on a foundational bottom 15 as depicted in FIG. 7 without horizontal rebars 13 for some applications and in some non-hurricane and non-earthquake areas. Optionally, the ring base 1 can rest on horizontal rebars 13 that preferably are positioned on riser blocks 16 as shown in FIG. 8 for increased structural integrity. For yet greater structural integrity, the ring base 1 can be positioned under horizontal rebars 13 on riser blocks 16 between the ring bases 1 as depicted in FIGS. 9 and 14. Whether ring bases 1 can be employed without horizontal rebars 13 depends partly on how well the ring bases 1 are constructed in relation to particular building requirements for particular states and areas of the Country.

Referring to FIGS. 10–12, for some areas and for some types of construction, non-bent vertical rebars 17 of sufficient quality and rebar-locking means can be used on ring bases 1 having tubular rebar receptacles 18.

Referring to FIGS. 13–14, a method for using this vertical-rebar support system is rotating an assembled ring base 1 and vertical rebar 5 or 17 to position the vertical rebar 5 or 17 laterally, as desired between the side walls 2 of the concrete-foundational excavation 3, and moving the ring base 1 generally parallel to the side walls 2 to position the vertical rebar as desired laterally and linearly intermediate terminal positions of the concrete-foundational excavation 3.

The vertical rebar such as the L-bent rebar 5 or the non-bent vertical rebar 17 can be attached to a selected ring base 1 either before or after positioning the ring base 1 in the concrete-foundational excavation 3.

To assist in aligning one or more of the vertical rebars 5 or 17 laterally between the side walls 2 and to assist in spacing one or a plurality of the vertical rebars 5 or 17 intermediate terminal ends 19 of the concrete-foundational excavation 3, a guide line 20 is positioned between the terminal ends 19.

The ring bases 1 can be positioned on top of the horizontal rebars 13 as in FIG. 13 or under the horizontal rebars 13 as in FIG. 14. The horizontal rebars can be positioned on riser blocks 16 whether under or over the ring bases 1. Positioning the horizontal rebars 13 and/or the ring bases 1 on riser blocks 16 allows concrete to flow under them for additional cement-locking relationship in concrete-foundational excavations 3 having sufficient depth to accommodate the riser blocks 16.

This vertical-rebar-support system can be used for a wide variety of buildings with a wide variety of materials in all areas of the country. It facilitates spacing of high-strength vertical rebars for positioning within in-line structural orifices of concrete blocks for pouring columns of reinforced concrete. Additionally, it facilitates positioning of reliable rebar for anchoring walls and roofs of wood, steel, plastic and other types of buildings for protection against hurricane, tornado, earthquake, tidal-wave and other natural disasters. It can be designed for the most to the least rigorous of rebar anchorage to concrete for all sizes, shapes and types of building construction.

A new and useful vertical-rebar-support system and method having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A method comprising the following steps for using a vertical-rebar support system with a ring base having an outside periphery that fits horizontally intermediate side walls of a concrete-foundational excavation; and at least one vertical-rebar receptacle that is oriented vertically and affixed to a top of the ring base intermediate a center and the outside periphery of the ring base:

rotating at least one assembled ring base and vertical rebar in a concrete-foundational excavation to position the vertical rebar laterally as desired between the side walls of the concrete-foundational excavation; and moving the ring base parallel to the side walls of the concrete-foundational excavation to position the vertical rebar as desired intermediate terminal positions of the concrete-foundational excavation.

2. A method as described in claim 1 wherein:

the vertical rebar has a rebar-L-base, the vertical-rebar receptacle has a side entry, a rebar-L-base receptacle is positioned on the ring base; and attaching the vertical rebar to the ring base for an assembled ring base and vertical rebar is achieved by positioning a vertical section of the vertical rebar in the vertical-rebar receptacle and by positioning the rebar-L-base in the rebar-L-base receptacle.

3. A method as described in claim 1 wherein:

at least one foundational rebar is oriented horizontally and positioned proximate a bottom of the concrete-foundational excavation and:

the ring base is placed on top of the at least one foundational rebar.

4. A method as described in claim 1 wherein:

the ring base is placed proximate a bottom of the concrete-foundational excavation and at least one foundational rebar in horizontal orientation is positioned vertically above the ring base on at least one riser block.

5. A method as described in claim 1 wherein:

a guide line is positioned vertically above the concrete-foundational excavation to align the at least one vertical rebar as desired between sides and intermediate terminal ends of the concrete-foundational excavation; and the vertical rebar is positioned as desired intermediate terminal walls of the concrete-foundational excavation by rotating the ring base to position the vertical rebar laterally for alignment in positional relationship to the guide line between the side walls of the concrete-foundational excavation and by moving the ring base parallel to the side walls of the concrete-foundational excavation to space the vertical rebar intermediate terminal positions of the concrete-foundational excavation in relationship to a plurality of ring bases with vertical rebars in the concrete-foundational excavation.

* * * * *